US012516449B2

(12) United States Patent
Kawahara et al.

(10) Patent No.: US 12,516,449 B2
(45) Date of Patent: Jan. 6, 2026

(54) WOVEN/KNITTED FABRIC

(71) Applicant: Toray Industries, Inc., Tokyo (JP)

(72) Inventors: Shinya Kawahara, Otsu (JP); Kojiro Inada, Otsu (JP); Tomohiko Matsuura, Mishima (JP); Masato Masuda, Mishima (JP)

(73) Assignee: Toray Industries, Inc., Tokyo (JP)

( * ) Notice: Subject to any disclaimer, the term of this patent is extended or adjusted under 35 U.S.C. 154(b) by 295 days.

(21) Appl. No.: 18/035,998

(22) PCT Filed: Nov. 5, 2021

(86) PCT No.: PCT/JP2021/040729
§ 371 (c)(1),
(2) Date: May 9, 2023

(87) PCT Pub. No.: WO2022/113695
PCT Pub. Date: Jun. 2, 2022

(65) Prior Publication Data

US 2024/0018703 A1 Jan. 18, 2024

(30) Foreign Application Priority Data

Nov. 25, 2020 (JP) ..... 2020-194853

(51) Int. Cl.
*D01F 8/14* (2006.01)
*D06M 11/00* (2006.01)

(52) U.S. Cl.
CPC ..... *D01F 8/14* (2013.01); *D06M 11/00* (2013.01); *D10B 2331/04* (2013.01);
(Continued)

(58) Field of Classification Search
CPC .... D03D 15/37; D03D 15/283; D03D 15/292; D03D 13/008; D01F 8/14; D04B 1/12;
(Continued)

(56) References Cited

U.S. PATENT DOCUMENTS

2018/0245244 A1 8/2018 Michinobu et al.

FOREIGN PATENT DOCUMENTS

CN 102505164 A 6/2012
CN 105256398 A 1/2016
(Continued)

OTHER PUBLICATIONS

International Search Report and Written Opinion for International Application No. PCT/JP2021/040729, dated Jan. 11, 2022, 5 pages.
(Continued)

*Primary Examiner* — Camie S Thompson
(74) *Attorney, Agent, or Firm* — Buchanan Ingersoll & Rooney PC

(57) ABSTRACT

To provide a woven/knitted fabric having excellent fabric/skin separation, a woven/knitted fabric is provided that includes C-shaped cross-section fibers, wherein an average standard deviation Sq of surface roughness of at least one surface of the woven/knitted fabric is 5 μm or more and 100 μm or less, and a ratio (Sqs/Sq) of an average standard deviation Sqs of surface roughness of the one surface when the woven/knitted fabric is elongated by 10% to the average standard deviation Sq, is 0.85 or more and 2.00 or less.

10 Claims, 2 Drawing Sheets

(52) U.S. Cl.
CPC .... *D10B 2401/022* (2013.01); *D10B 2501/00* (2013.01); *Y10T 442/2352* (2015.04)

(58) Field of Classification Search
CPC .... D04B 1/16; Y10T 442/2352; D06M 11/00; D10B 2401/02; D10B 2401/022; D10B 2401/06; D10B 2501/00
USPC ..... 442/102
See application file for complete search history.

(56) References Cited

FOREIGN PATENT DOCUMENTS

| | | | | |
|---|---|---|---|---|
| CN | 108138398 | A | | 6/2018 |
| JP | 60194147 | A | | 10/1985 |
| JP | 62299545 | A | | 12/1987 |
| JP | 2001303408 | A | | 10/2001 |
| JP | 2002-030551 | A | | 1/2002 |
| JP | 2005-248408 | A | | 9/2005 |
| JP | 2009174067 | A | | 8/2009 |
| JP | 2016098439 | | * | 5/2016 |
| JP | 6228718 | B1 | | 11/2017 |
| JP | 6578650 | B2 | | 9/2019 |
| JP | 2020186503 | A | | 11/2020 |

OTHER PUBLICATIONS

Extended European Search Report issued Sep. 9, 2024, by the European Patent Office in corresponding European Patent Application No. 21897671.0-1017. (125 pages).

Office Action (The First Office Action) issued Mar. 26, 2025, by the State Intellectual Property Office of People's Republic of China in corresponding Chinese Patent Application No. 202180077727.8 and an English translation of the Office Action. (12 pages).

Office Action (Notice of Reasons for Refusal) issued Jun. 3, 2025, by the Japan Patent Office in corresponding Japanese Patent Application No. 2021-572367 and an English translation of the Office Action. (6 pages).

* cited by examiner

[Fig. 1]
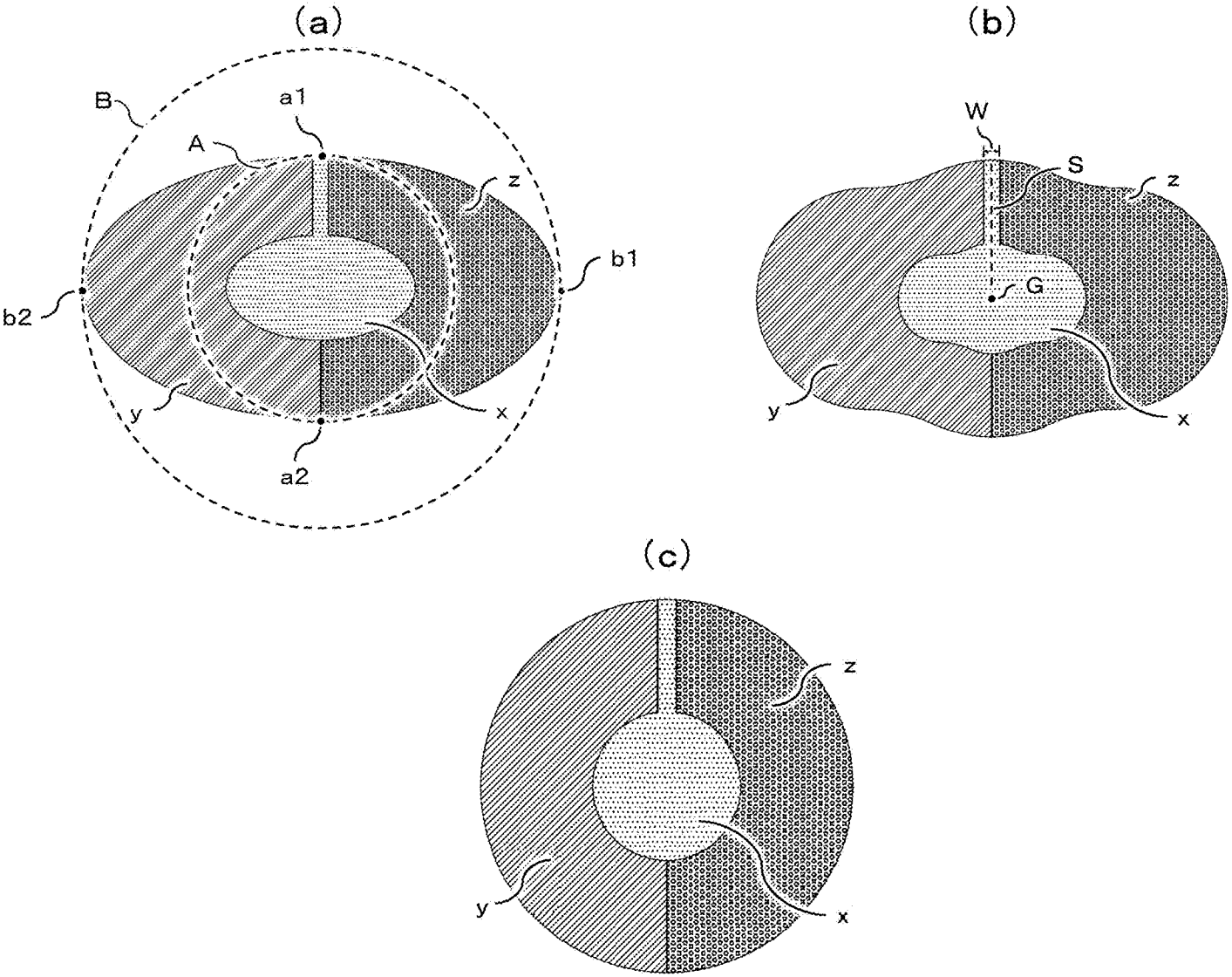

[Fig. 2]
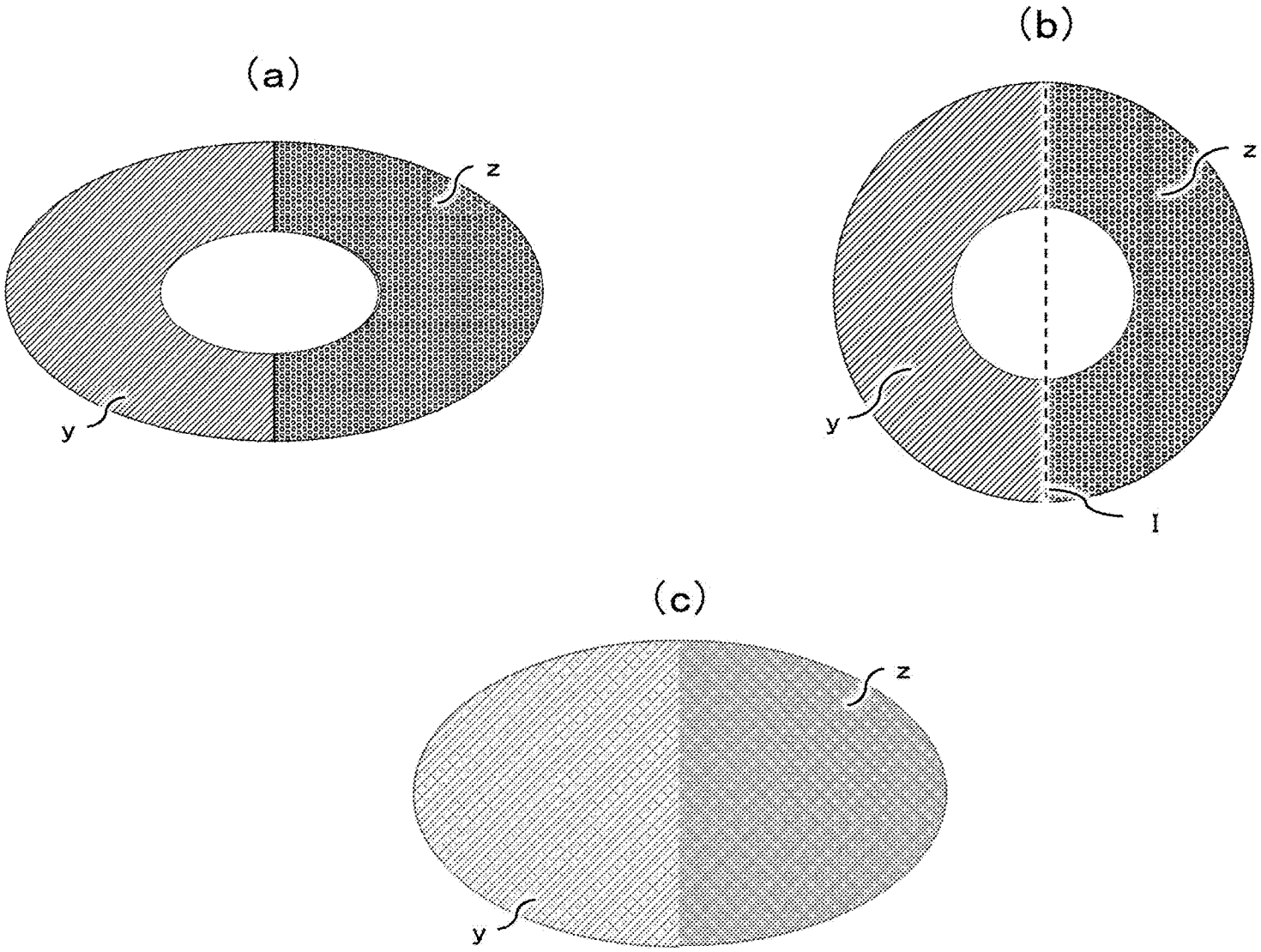

WOVEN/KNITTED FABRIC

CROSS REFERENCE TO RELATED APPLICATIONS

This application is the U.S. National Phase of PCT/JP2021/040729, filed Nov. 5, 2021, which claims priority to Japanese Patent Application No. 2020-194853, filed Nov. 25, 2020, the disclosures of these applications being incorporated herein by reference in their entireties for all purposes.

FIELD OF THE INVENTION

The present invention relates to a woven/knitted fabric having excellent wearing comfortability and a natural-like appearance.

BACKGROUND OF THE INVENTION

Synthetic fibers made of polyester, polyamide and the like have excellent dynamic characteristics and dimensional stability, and thus are widely used from clothing applications to non-clothing applications. In recent years, as people's life has diversified and better life has been demanded, fibers having more advanced touch and function have been demanded.

Textiles for clothing tend to require excellent wearing comfortability. In particular, in underwear, shirts and the like that are in contact with human skin, sweat absorbency, quick-drying property, good fabric/skin separation, and followability to body movements such as stretchability are required, and various technologies have been proposed to date.

Patent Document 1 describes that a knitted fabric using flat yarns having a flat shaped cross section can increase the fiber surface area and impart excellent water absorbency and moisture transpiration.

Further, in Patent Document 2, the degree of surface unevenness is increased and the water retention rate in the fabric is increased to reduce the fabric sticking.

In addition, natural materials such as cotton, linen, wool, or Japanese paper have a non-uniform surface feeling, and as a feature of the natural materials, it has been preferred and used from clothing applications to non-clothing applications. On the other hand, it has been pointed out that when a filament of a synthetic fiber is used, the uniformity of the fiber is high, and a natural-like non-uniform unevenness feeling cannot be obtained.

PATENT DOCUMENTS

Patent Literature 1: Japanese Patent Laid-open Publication No. 2009-174067

Patent Literature 2: Japanese Patent Laid-open Publication No. 2001-303408

SUMMARY OF THE INVENTION

However, even in Patent Documents 1 and 2, comfortability during wearing, particularly during exercise, and in particular, the fabric/skin separation of the fabric when sweating, are not necessarily sufficiently effective, and further improvement is desired.

Furthermore, in recent years when the temperature is high in the summer season, the amount of sweat increases, and sweat taken in from the skin surface tends to easily shift to the surface. As office wear becomes more casual, there are more opportunities to wear a jacket directly over underwear or T-shirts. In this case, a problem has become apparent in which sweat oozes out from underwear and the like into the jacket, and sweat stains are formed even on the lining or surface of the jacket. It can be improved, for example, by increasing the water absorbency by making the underwear thick, but if the underwear is thicker, there is a problem that the amount of sweating increases or exercise comfortability is impaired.

In view of the above-described problems of the prior art, an object of the present invention is to improve the fabric/skin separation of the fabrics during wearing, particularly to solve the problem that the effect thereof is reduced by exercise and the like. Another object of the present invention is to achieve compatibility with reduction of the oozing of sweat. In addition, it is also an object to achieve a natural-like surface feeling with synthetic fibers so that the synthetic fibers can be suitably used as a woven/knitted fabric for clothing.

In order to achieve the above object, the present invention has the following configurations.

(1) A woven/knitted fabric including C-shaped cross-section fibers, wherein an average standard deviation Sq of surface roughness of at least one surface of the woven/knitted fabric is 5 μm or more and 100 μm or less, and a ratio (Sqs/Sq) of an average standard deviation Sqs of surface roughness of the one surface when the woven/knitted fabric is elongated by 10% to the average standard deviation Sq, is 0.85 or more to 2.00 or less.

(2) The woven/knitted fabric according to (1), wherein the C-shaped cross-section fibers have a ratio (RB/RA) of an inscribed circle diameter RA to a circumscribed circle diameter RB in the cross-section of 1.2 or more and 5.0 or less.

(3) The woven/knitted fabric according to (1) or (2), wherein the C-shaped cross-section fibers are C-shaped cross-section fibers in which at least two different types of polymers are unevenly distributed in the left and right in the C-shaped cross-section fibers.

(4) The woven/knitted fabric according to any one of (1) to (3), wherein the woven/knitted fabric includes at least one type of weave selected from a twill weave, a multiple weave, a fraise stitch, and a seed stitch.

(5) The woven/knitted fabric according to any one of (1) to (4), comprising a water-absorbent polyester resin.

(6) The woven/knitted fabric according to any one of (1) to (5), having a water retention rate of 20% or more.

(7) The woven/knitted fabric according to any one of (1) to (6), wherein a oozing rate is 40% or less.

The woven/knitted fabric of the present invention can provide clothing having excellent wearing comfortability and appearance by reducing the fabric sticking to the skin and the oozing of sweat during wearing.

BRIEF DESCRIPTION OF THE DRAWINGS

FIG. 1 shows a schematic view of a cross-sectional structure of a C-shaped cross-section fiber in the present invention.

FIG. 2 shows a schematic view of a cross-sectional structure of a conventional conjugate fiber.

DETAILED DESCRIPTION OF EMBODIMENTS OF THE INVENTION

Hereinafter, the present invention will be described in detail together with desirable embodiments.

In a woven/knitted fabric of the present invention, an average standard deviation Sq of surface roughness on at least one surface is 5 μm or more and 100 μm or less. Both surfaces of the woven/knitted fabric may have an average standard deviation Sq of surface roughness of 5 μm or more and 100 μm or less. The average standard deviation Sq of the surface roughness as used herein is calculated by a method described later. When Sq is less than 5 μm, there is no unevenness feeling on the fabric surface, and the fabric/skin separation is decreased. In addition, the surface of the woven/knitted fabric becomes uniform, and the natural material-like appearance is impaired. Moreover, when Sq is more than 100 μm, the unevenness feeling of the fabric surface is too large, so that the skin feeling of the clothing is bad when worn, resulting in a rough feeling. By setting Sq to 5 μm or more and 100 μm or less, it is possible to achieve both the skin feeling during wearing and fabric/skin separation when sweating due to the moderate unevenness feeling and non-uniformity of the fabric surface, and it is possible to obtain a surface having natural-like feeling. Furthermore, since the contact area with the skin is reduced, it is possible to suppress feeling cold from sweat due to the fabric that has absorbed water. The lower limit of Sq is preferably 30 μm or more, and more preferably 40 μm or more. The upper limit of Sq is preferably 90 μm or less, and more preferably 80 μm or less.

In the woven/knitted fabric of the present invention, a ratio Sqs/Sq of an average standard deviation Sqs of surface roughness of at least one surface when the woven/knitted fabric is elongated by 10% to the above-mentioned Sq on the same surface as the Sqs is 0.85 or more and 2.00 or less. Sqs as used herein is calculated by a method described later.

As a result of studying the reason for reducing the fabric/skin separation during exercise and the like, a phenomenon in which the unevenness feeling of the fabric surface is reduced when the fabric is elongated by the movement of the body could be confirmed. The present inventors have found that this reduction in unevenness feeling leads to a decrease in fabric/skin separation, that is, a phenomenon in which the fabric sticks around a shoulder, a back, or an elbow. That is, this can be solved if the reduction in unevenness feeling of the fabric surface can be suppressed when the fabric is elongated. Since the conventional woven/knitted fabric has not paid attention to the Sqs, the fabric/skin separation is not satisfactory, particularly during exercise and the like. Sqs is preferably 5 μm or more and 200 μm or less, in order to solve this problem. By setting Sqs to 5 μm or more, the fabric/skin separation can be improved. Sqs is more preferably 30 μm or more. In addition, by setting Sqs to 200 μm or less, the skin feeling when elongated is further improved. However, a relative value of Sqs, that is, a ratio of Sqs to Sq in a non-elongated state is a particularly important index for wearing comfortability rather than an absolute value of Sqs. When the Sqs/Sq is less than 0.85, the fabric sticks to the skin at a portion where the fabric is elongated by exercise, and the wearing comfortability is reduced. In the conventional woven/knitted fabric, even if there is unevenness on the surface, the surface is smoothed and equalized by elongation and the Sqs/Sq becomes less than and the magnitude of the change is one of the causes of greatly deteriorating the wearing comfortability. In addition, when Sqs/Sq is more than 2.00, the unevenness change of the elongated portion of the fabric becomes too large, the wearer easily feels a rough touch, and the wearing comfortability is also reduced. By setting Sqs/Sq to 0.85 or more and 2.00 or less, wearing comfortability during exercise can be obtained. The lower limit of Sqs/Sq is preferably or more, and more preferably 0.95 or more. The upper limit of Sqs/Sq is preferably 1.70 or less, and more preferably 1.60 or less.

As means for setting Sq and Sqs/Sq to the above ranges, it is possible to appropriately combine the structure of the woven/knitted fabric, the properties of the yarn and the like. As the structure of the woven/knitted fabric, for example, in the case of a woven fabric, a twill weave, a multiple weave such as a double weave, and in the case of a knitted fabric, a fraise stitch, a seed stitch and the like are preferable because these structure are easily within the scope of the present invention. The twill weave is a more preferred aspect because of its excellent productivity and easy control of surface roughness by elongation of the fabric. In addition, as the properties of the yarns to be constituted, for example, false twisted yarns, sheath/core composite cross-section fibers, and side-by-side conjugate yarns can be used, and when the yarns have a flat cross-sectional shape, crimped yarns including portions with aligned phases can be used. In particular, in the present invention, a flat yarn is preferable, and it is more preferable that 10% or more of the yarns of the multifilament are oriented in the same direction because it is easy to set Sqs/Sq in the present invention within the above range. The term "oriented in the same direction" as used herein means that, in a transverse section image including 20 or more flat yarns that are multifilament, when the angle formed by an arbitrary reference straight line and an angle of a major axis of the cross section of the flat yarn is measured at 0 to 180 degrees for 20 yarns each, the number of flat yarns having an angle of 20 degrees or less is 10% or more. It is more preferable that the number of flat yarns having an angle of 10 degrees or less is 10% or more. As described later, the flat yarn refers to a flat yarn having RB/RA of more than 1, and RB/RA is preferably 1.2 or more. When a side-by-side conjugate yarn having a flat cross-sectional shape is used, a crimped yarn having an aligned phase is easily obtained, which is a preferred aspect of the present invention. In this aspect, the yarn having high flatness can be twisted in a ribbon shape in the range of Sq or Sqs/Sq in the present invention, and the unevenness feeling of the fabric surface can be increased. Furthermore, since the yarn bundle moves in the thickness direction while being twisted when the fabric is elongated, Sq and Sqs/Sq are preferably in a more preferable range. When processing such as false-twist crimping is performed, it tends to be difficult to align the phases. False twisted yarns tend to have a uniform surface due to dispersion of expressed crimps, but may be used as long as the range of Sq and Sqs/Sq in the present invention is satisfied.

The elongation rate in the woven/knitted fabric of the present invention is preferably 10% or more, and more preferably 20% or more from the viewpoint of wearing comfortability. In addition, it is preferably 50% or less, and more preferably 40% or less from the viewpoint of excellent fabric/skin separation during wearing. As the elongation rate in the present invention, a method described in Examples described later can be employed.

The woven/knitted fabric of the present invention includes C-shaped cross-section fibers. The C-shaped cross-section fiber is preferably 20% by weight or more, more preferably 90% by weight or more, of the woven/knitted yarn. For example, in the case of a woven fabric, as long as the range defined in the present invention is satisfied, it can be used for at least a part or all of the warp yarns and the weft yarns. The above C-shaped cross-section fibers may be used only for the warp yarns or only for the weft yarns, but it is preferable that it is used for at least a part or all of the warp yarns and the weft yarns.

The C-shaped cross-section fiber in the present invention refers to a yarn having a hollow fiber wall partially opened continuously in the fiber axis direction and having a substantially C-shaped (including those that look appears substantially V-type or U-type when deformed) cross-section shape. By comprising a C-shaped cross-section yarn, water absorbency can be improved by a C-shaped opening, and the skin surface can be dried. As described above, the surface roughness is an important index for improving the fabric/skin separation, but the effect is extremely excellent particularly when sweating due to the water absorbency at the opening. Any one of them does not produce the effect of the present invention. Even when the surface roughness is within the range of the present invention, if the above opening is not provided, the fabric/skin separation is poor. In addition, even if there is the above opening, if the surface roughness is not within the range of the present invention, the fabric/skin separation is also poor.

Furthermore, since moisture absorbed on the skin side can be taken into a hollow part inside the fiber, sweat transfer to the outer can be suppressed when wearing in layers and the like. This makes it possible to achieve both fabric/skin separation and reduction in sweat transfer.

In the present invention, it is preferable that the C-shaped cross-section fiber is obtained from an elution type hollow fiber because cross-sectional deformation can be suppressed in processing steps such as false twisting and twisted yarns. The elution type hollow fiber referred to in the present invention is a fiber that has a sheath/core structure including a core component made of an easily soluble polymer and a sheath component made of a hardly soluble polymer, and can form a yarn having a C-shaped cross-sectional shape by removing the core component. It is preferable to use a yarn in which a part of the core component is exposed from the opening of the sheath component to the fiber surface in the transverse section of fiber and which has a communication part communicating from the fiber center to the fiber surface.

The width of the communication part (hereinafter, it may be simply referred to as a "communication width") is preferably 10% or less of the fiber diameter. The fiber diameter is determined by embedding a conjugate fiber in an embedding agent such as an epoxy resin and taking an image at a magnification at which 10 filaments or more of the fiber can be observed with a scanning electron microscope (SEM) in the transverse section of fiber in a direction perpendicular to the fiber axis. From each taken image, a fiber diameter randomly extracted in the same image is measured to one decimal place in units of μm. Then, a simple number average of the results of the measurement for 10 filaments is determined, and the value obtained by rounding off the average to the nearest whole number is taken as the fiber diameter (μm). Here, when the transverse section of fiber in a direction perpendicular to the fiber axis is not a perfect circle, the area thereof is measured, and a value of the diameter obtained by converting it into a perfect circle is employed. The communication width is measured by embedding a fiber in an embedding agent such as an epoxy resin, and taking an image at a magnification at which 10 or more of the fiber can be observed with a transmission electron microscope (TEM) in the transverse section of fiber in a direction perpendicular to the fiber axis. When the easily soluble polymer is communicated from the fiber center to the fiber surface, analysis is performed using known analysis software capable of measuring the length of an image. Referring to FIG. 1, first, the shortest width of a width W (for example, W in FIG. 1(*b*)) of a communication part in the direction perpendicular to a straight line S (for example, S in FIG. 1(*b*)) that passes through a fiber center G and is parallel to the communication part is calculated in units of μm. Then, a simple number average of the obtained results of the measurement for 10 filaments is determined, and the value obtained by rounding off the average to one decimal place is taken as the communication width. Further, a value obtained by dividing the communication width obtained for each filament by the fiber diameter and multiplying the obtained value by 100 was calculated, a simple number average of the results obtained for 10 filaments was obtained, and the obtained value was rounded off to the nearest whole number and taken as a ratio (%) of the communication width to the fiber diameter.

When the communication width is 10% or less of the fiber diameter, it is possible to prevent crushing of the hollow part due to biting between fibers or misalignment of the opening without impairing water absorbency and water retainability. When the communication width is 5% or less of the fiber diameter, fibrillation due to fiber abrasion caused by opening formed after elution of the easily soluble polymer can be suppressed. Further, when post-processing with a functional agent is performed, the functional agent that has entered the hollow part can be prevented from falling off due to washing and the like, and washing durability of the functional agent can be greatly improved, which is more preferable. In addition, it is also possible to prevent the retained moisture from oozing out to the outside when water absorption processing is performed. However, if the communication width is too narrow, it is difficult to remove the easily soluble polymer in the core part, and thus the substantial lower limit of the communication width is 1% of the fiber diameter.

The C-shaped cross-section fibers can employ any modified cross section such as a flat shape, a multi-lobe shape, a polygonal shape, a gear shape, a petal shape, and a star shape, but is preferably a flat shape or a multi-lobe shape from the viewpoint of an appropriate fabric/skin separation. When the fiber has a flat shape, the phases of the crimps are easily aligned, and it becomes easy to control the surface roughness within the range of the present invention. In addition, when the fiber has a multi-lobe shape, since the fiber surface is provided with unevenness, the glittering due to the diffused reflection of light can be suppressed and the water-absorbent and quick-drying property due to the fine voids between fibers can be improved, and dry touch can also be obtained by the unevenness being caught by fingers when touched by hands. However, if the number of the recess/protrusion portions is too large, the interval between the recess/protrusion portions becomes small, and the effect thereof gradually decreases, thus, the substantial upper limit of the number of protrusion portions included in the multi-lobe shape in the present invention is 20.

The C-shaped cross-section fiber of the present invention preferably have a ratio (RB/RA) of an inscribed circle diameter RA to a circumscribed circle diameter RB of the fiber in the transverse section of fiber of 1.2 or more and 5.0 or less. Here, the inscribed circle diameter RA and the circumscribed circle diameter RB in the present invention are determined by embedding a fiber in an embedding agent such as an epoxy resin and taking an image at a magnification at which 10 filaments or more of the fiber can be observed with a scanning electron microscope (SEM) in the transverse section of fiber in a direction perpendicular to the fiber axis. Fibers randomly extracted in the same image from each taken image are analyzed using analysis software capable of measuring the length of an image. The diameter of a circle (for example, A in FIG. 1(*a*)) inscribed on the fiber surface at least two points (for example, a1 and a2 in FIG. 1(*a*)), present only inside the fiber, and has the maximum diameter that can be taken within a range in which the circumferences of the inscribed circle do not intersect the fiber surfaces is calculated, a simple number average of the results of the measurement for 10 filaments is determined, and the value obtained by rounding off the average to the nearest whole number is taken as the inscribed circle diameter RA.

In addition, the diameter of a circle (for example, B in FIG. 1(*a*)) circumscribed on the fiber surface at least two points (for example, b1 and b2 in FIG. 1(*a*)), present only outside the fiber, and has the minimum diameter that can be taken within a range in which the circumferences of the circumscribed circle do not intersect the fiber surfaces is calculated, a simple number average of the results of the measurement for 10 filaments is determined, and the value obtained by rounding off the average to the nearest whole number is taken as the circumscribed circle diameter RB. RB/RA was calculated from a value obtained by dividing RB obtained in each fiber by RA, a simple number average of the results obtained for 10 filaments was obtained, and the value obtained by rounding off the average to one decimal place is taken as RB/RA.

By setting RB/RA to 1.2 or more, the fabric/skin separation due to surface unevenness is improved. RB/RA is more preferably 1.5 or more. Moreover, by setting RB/RA to or less, it is possible to obtain a woven/knitted fabric having an excellent surface quality by suppressing glittering and the like due to being flat. RB/RA is more preferably 4.0 or less. In the present invention, the method for setting the above range is not particularly limited, but can be obtained by using, for example, a spinneret described later.

In addition, the above-mentioned easily soluble polymer means a polymer having a relatively high dissolution rate with respect to a solvent used for the dissolution treatment, and the hardly soluble polymer means a polymer having a slow dissolution rate. In addition, dissolution and elution in the present invention include a case where the polymer is decomposed and apparently dissolved.

As the polymer constituting the C-shaped cross-section fiber in the present invention, thermoplastic polymer is preferred because of its excellent workability, and polymer groups such as polyester-, polyethylene-, polypropylene-, polystyrene-, polyamide-, polycarbonate-, polymethyl methacrylate-, and polyphenylene sulfide-based polymer, and copolymers thereof are preferable. From the viewpoint that particularly high interface affinity can be imparted and a fiber having no composite cross-sectional abnormality can be obtained, all of the thermoplastic polymers used in the conjugate fiber of the present invention are preferably the same polymer groups and copolymers thereof. Further, the polymer may contain various additives such as inorganic substances such as titanium oxide, silica, and barium oxide; colorants such as carbon black, dyes, and pigments; flame retardants; fluorescent brighteners; antioxidants; and ultraviolet absorbers.

The easily soluble polymer is preferably selected from polymers which can be melt-molded and exhibit more easily elution than other components, such as polyester and copolymers thereof, polylactic acid, polyamide, polystyrene and a copolymer thereof, polyethylene, and polyvinyl alcohol. In addition, from the viewpoint of simplifying the elution step of the easily soluble polymer, the easily soluble polymer is preferably a copolyester, polylactic acid, polyvinyl alcohol or the like which exhibit easily elution in an aqueous solvent, hot water or the like. In particular, a polyester in which 5-sodium sulfoisophthalic acid is copolymerized in an amount of 5 mol % to 15 mol % and a polyester in which polyethylene glycol having a weight-average molecular weight of 500 to 3000 is copolymerized in the range of 5 wt % to 15 wt % in addition to 5-sodium sulfoisophthalic acid are particularly preferable from the viewpoint that fusion or the like between conjugate fibers does not occur even in false-twisting processing or the like in which rubbing is imparted under heating because of crystallinity, and high order processing passability is excellent because of easily elution in an aqueous solvent such as an alkaline aqueous solution.

In the C-shaped cross-section fiber in the present invention, at least two different types of polymers are preferably unevenly distributed in the left and right. The different polymers are not particularly limited as long as they differ in at least one of the chemical composition, the presence or absence of copolymerization, the copolymerization ratio, the position of the copolymer such as random copolymerization or block copolymerization, the chemical structure, the weight average or number average molecular weight, the melting point, but the polymers having different melting points are preferred from the viewpoint of ease of crimp expression. When the chemical composition and the like is different, the melting point is usually different, and there may be a plurality of different items. The expression "different polymers are unevenly distributed in the right and left" means that, for example, in the case where the fiber is made of two types of polymers, different polymers are mainly disposed in the left and right fiber cross sections with the straight line as a boundary among straight line that equally divide the fiber cross section into two parts by area through the fiber center. It is preferable that there is a straight line (for example, a straight line I in FIG. 2(*b*)) such that the area ratio of the different polymers in the fiber cross section is 100:0 to 70:30 in one of the left and right fiber cross sections and in the range of 30:70 to 0:100 in the other fiber cross section. That is, the area ratio of each polymer is preferably in the range of 70/30 to 30/70. Within such a range, it is difficult to be affected by texture hardening that occurs when one polymer is highly shrunk by heat treatment, and a crimped form due to a different shrinkage can be sufficiently expressed.

The composite structure in the above conjugate fiber is not particularly limited, and examples of the composite structure include a sheath/core type and a blend type in addition to a side-by-side type and a islands-in-the-sea type. From the viewpoint of increasing the crimp expressing ability by increasing the distance between the centers of gravity, it is preferable that the hard soluble polymers having different melting points, for example, the hard soluble polymer on the relatively low melting point side and the hard soluble polymer on the relatively high melting point side are bonded in a side-by-side type in which the hard soluble polymers are unevenly distributed in the left and right. In the case of side-by-side bonding, since the interface between the hardly soluble polymers having different melting points is small, the distance between the centers of gravity of the polymers in the composite cross-section can be increased to the maximum. As a result, not only the crimp expressing ability can be maximized, but also stretchability can be imparted, and wearing comfortability such as stress free can be obtained with a moderately stretchable fabric, which is a more preferable range.

Examples of the polymer include the thermoplastic polymer groups that can be melt-molded such as polyester-, polyethylene-, polypropylene-, polystyrene-, polyamide-, polycarbonate-, polymethyl methacrylate-, and polyphenylene sulfide-based polymer, and copolymers thereof. In the case of polymers having different melting points, the difference between the melting point of the highest polymer and the melting point of the lowest polymer among the polymers to be combined is preferably 10° C. or higher, and more preferably 20° C. or higher.

The main reason why the C-shaped cross-section fiber in the present invention is preferably made of at least two different types of polymers is that a crimped form is expressed due to a different shrinkage. As a combination of different polymers, it is preferable that at least one polymer is a high shrinkage low melting point polymer and at least another polymer is a low shrinkage high melting point polymer. From the viewpoint of providing stability in high order processing and durability in use to the fabric by suppressing peeling, the combination of the polymers is preferably selected from the same polymer groups having the same bond in the main chain, such as polyester-based ester bond and polyamide-based amide bond. Examples of such combinations in the same polymer groups include, but are not limited to, polyester-based combinations such as copolymerized polyethylene terephthalate/polyethylene terephthalate, polybutylene terephthalate/polyethylene terephthalate, polytrimethylene terephthalate/polyethylene terephthalate, thermoplastic polyurethane/polyethylene terephthalate, polyester-based elastomer/polyethylene terephthalate, and polyester-based elastomer/polybutylene terephthalate; polyamide-based combinations such as nylon 66/nylon 610, nylon 6-nylon 66 copolymer/nylon 6 or 610, PEG-copolymerized nylon 6/nylon 6 or 610, and thermoplastic polyurethane/nylon 6 or 610; and polyolefin-based combinations such as ethylene-propylene rubber fine dispersion polypropylene/polypropylene, and propylene-α-olefin copolymer/polypropylene, and the like. From the viewpoint of suppressing collapse of the hollow part inside the fiber because of high bending rigidity and obtaining good color developability when dyed, the hardly soluble polymers having different melting points are more preferably a polyester-based combination. Examples of the copolymerization component in the copolymerized polyethylene terephthalate include succinic acid, adipic acid, azelaic acid, sebacic acid, 1,4-cyclohexanedicarboxylic acid, maleic acid, phthalic acid, isophthalic acid, and 5-sodium sulfoisophthalic acid, and the like. From the viewpoint that the different shrinkage from polyethylene terephthalate can be maximized, polyethylene terephthalate copolymerized with 5 to 15 mol % of isophthalic acid is preferable.

The C-shaped cross-section fiber in the present invention preferably has a fiber diameter of 20 μm or less from the viewpoint of further softening the feel. Within such a range, a repulsive feeling can be sufficiently obtained in addition to flexibility, and the range is suitable for clothing applications requiring a resilient texture such as pants and shirts. When the fiber diameter is 15 μm or less, flexibility is increased, and the crimped form expressed by heat treatment also becomes fine. Since dry touch can also be obtained by the fact that the unevenness due to the crimp is caught on the finger when touched with the hand, the range is suitable for clothing applications such as an inner or a blouse that touches the skin. The fiber diameter is preferably 8 μm or more from the viewpoint of maintaining the bending recovery, obtaining an appropriate repulsive feeling, and obtaining excellent color developability.

The woven/knitted fabric of the present invention preferably contains a water-absorbent resin or a hydrophilic group in order to further improve the fabric/skin separation. A woven/knitted fabric containing these water-absorbent resins and hydrophilic groups can be generally obtained by water absorption processing of the woven/knitted fabric. Examples of the water absorption processing include alkali reduction processing of polyester, and adhesion processing of polyethylene glycol and a water absorbent polyester resin such as a polyester polyalkylene glycol copolymer resin, and a processing agent having hydrophilicity such as cellulose and hydrophilic silicon to fibers. The woven/knitted fabric of the present invention is a preferred aspect because the effect of improving water absorbency is high and the washing durability is also high by containing the water absorbent polyester resin. A method of subjecting the woven/knitted fabric to the water absorption processing is not particularly limited as long as a dyeing processing facility for processing a general woven fabric or circular knitted fabric is used. This water absorption processing may be performed simultaneously with or after dyeing in the dyeing step, or may be applied to the woven/knitted fabric by a padding method in the finishing stage and the like. The knitted fabric of the present invention may be separately subjected to various functional processing, and may be subjected to conventionally known processing such as antifouling processing such as SR processing, deodorizing processing, antimicrobial and/or bacteriostatic processing, UV cutting processing, friction melting processing, electrostatic processing, and skin care processing.

The woven/knitted fabric of the present invention preferably has a water retention rate of 20% or more, and more preferably 40% or more. The substantial upper limit of the water retention rate is about 80%. By setting the water retention rate is 20% or more, the fabric sufficiently absorbs sweat, and sweat transfer to the outer can be suppressed. The method for setting the water retention rate within the above range is not particularly limited, but for example, in order to have a structure having appropriate voids for taking in moisture in the fabric, various methods can be employed, such as using a crimped yarn, or using a structure in which the structure of a woven/knitted fabric becomes thick as a fabric such as multiple weaving or seed stitch. The water retention rate in the present invention can be measured by a method described later.

Moreover, in the woven/knitted fabric of the present invention, the oozing rate is preferably 40% or less, and more preferably 35% or less. The substantial lower limit of the oozing rate is about 5%. By the method for evaluating the oozing rate described later, the reproducibility of the actual degree of sweat transfer to the outer is improved and by setting the oozing rate to 40% or less, the sweat transfer to the outer can be further suppressed. The method for setting the oozing rate within the above described range is not particularly limited, but for example, by appropriately adjusting the amount of the C-shaped cross-section fiber in the present invention, moisture can be retained in the hollow part inside the yarn to be in the above range.

Next, a preferred method for producing the woven/knitted fabric of the present invention will be described.

The method for producing the C-shaped cross-section fiber in the present invention is not particularly limited, and the C-shaped cross-section fiber can be produced by a melt spinning method, a solution spinning method such as a wet method and a dry-wet method for the purpose of producing a long fiber. The melt spinning method is suitable from the viewpoint of enhancing productivity. In the melt spinning method, a composite spinneret to be described later can also be used, the spinning temperature at that time is set to a temperature at which a polymer having a high-melting point or a high-viscosity polymer among polymer types to be used exhibits fluidity. The temperature at which the polymer exhibits fluidity varies depending on the molecular weight, but when the temperature is set between the melting point of the polymer and the melting point +60° C., the fiber can be stably produced.

The spinning speed may be set to about 500 to 6000 m/min, and can be changed depending on the physical properties of the polymer and the intended use of the fiber. In particular, from the viewpoint of achieving high orientation and improving dynamic characteristics, it is preferable to set the drawing rate to 500 to 4000 m/min and then perform drawing because uniaxial orientation of the fibers can be promoted. At the time of drawing, the preheating temperature is preferably set appropriately based on a softening temperature such as the glass transition temperature of the polymer. The upper limit of the preheating temperature is preferably set to a temperature at which yarn path disturbance does not occur due to spontaneous elongation of the fiber in the preheating process. For example, in the case of PET whose glass transition temperature is around 70° C., the preheating temperature is usually set to about 80 to 95° C.

In addition, when the ejection amount per single hole of the spinneret in the C-shaped cross-section fiber of the present invention is set to about 0.1 to 10 g/min/hole, the fiber can be stably produced. The ejected polymer stream is cooled and solidified, then provided with an oil agent, and taken up by a roller having a prescribed rotational speed. Thereafter, the fiber is drawn by a heating roller to obtain a desired fiber.

As a composite spinneret used for producing a C-shaped cross-section fiber made of two or more types of polymers, for example, a composite spinneret described in Japanese Patent Laid-open Publication No. 2011-208313 and the like is suitably used. The composite spinneret is incorporated into a spinning pack in a state where mainly three types of members, that is, a measuring plate, a distribution plate, and an ejecting plate are stacked in this order from the top, and the pack is used for spinning.

The woven/knitted fabric of the present invention can be obtained by performing a weaving and dyeing processing by a conventionally known method using the above-mentioned C-shaped cross-section fiber. As a method for producing a woven/knitted fabric of the present invention, an example of dyeing processing in a woven/knitted fabric made of C-shaped cross-section fibers in which two different types of polymers are unevenly distributed in the left and right is shown below. First, the woven/knitted fabric is scoured as necessary and subjected to a moist-heat treatment, whereby crimps occur in the filament due to a difference in thermal shrinkage ratio between the two types of polymers constituting the woven/knitted fabric. This moist-heat treatment can be performed using a jet dyeing machine or the like. The temperature time may be set so as to increase the potential shrinkage rate of the polymer contained, and as the treatment temperature is increased or the treatment time is longer, the potential shrinkage rate of the polymer is increased and the fine crimp is expressed. After the moist-heat treatment, it is preferable to perform intermediate setting before eluting the easily soluble polymer for forming the C-shaped cross-section fiber. By performing this intermediate setting, it is possible to control the elongation rate of the woven/knitted fabric to be obtained. The intermediate setting can be performed by equipment such as a pin tenter, and the surface state and the elongation rate of the woven/knitted fabric can be controlled by appropriately changing the tension, the temperature, and the width. When the tension is increased, the fabric is elongated, so that the elongation rate decreases, but the wrinkles tend to be stretched and the surface quality tends to be improved. In addition, when the treatment temperature is increased, the settability is improved, but the thermal shrinkage of the fabric is also increased, so that the elongation rate tends to decrease. Therefore, these may be appropriately controlled to obtain a desired elongation rate.

Thereafter, the easily soluble polymer for forming the C-shaped cross-section fiber is eluted as necessary, whereby the C-shaped cross-section shape can be obtained. The elution of the easily soluble polymer can be performed by processing in a liquid capable of eluting the easily soluble polymer, such as an aqueous sodium hydroxide solution, using a jet dyeing machine or the like.

Furthermore, the woven/knitted fabric of the present invention may be subjected to dyeing, functional processing, and finish setting. In the woven/knitted fabric of the present invention, the crimp generated by the moist-heat treatment is maintained even after these post-processing steps, and stretchability can be imparted to woven/knitted fabric.

The woven/knitted fabric of the present invention can be suitably used for general clothing such as jackets, skirts, pants, and underwear, sports clothing, clothing materials, since the woven/knitted fabric of the present invention is excellent in wearing comfortability and appearance by reducing the fabric sticking to the skin and reducing the oozing of sweat to the outer during wearing.

EXAMPLES

Hereinafter, the woven/knitted fabric of the present invention will be specifically described with reference to Examples. The following evaluations A to H were performed for the examples and comparative examples.

A. Melting Point

A chip-shaped polymer or fibers and a part of the fibers collected from a woven/knitted fabric were dried in a vacuum dryer to a moisture ratio of 200 ppm or less, about 5 mg of the fibers was weighed, and the fibers were heated from 0° C. to 300° C. at a heating rate of 16° C./min using a differential scanning calorimeter (DSC) Q2000 manufactured by TA Instruments, and then held at 300° C. for 5 minutes to perform DSC measurement. The melting point was calculated from the melting peak observed during the heating process. The measurement was performed three times for each sample, and the average value thereof was taken as the melting point. When a plurality of melting peaks were observed, the melting peak top on the highest temperature side was taken as the melting point.

B. Fineness

The weight of 10 cm of the fiber collected from the raw yarn or the woven/knitted fabric before the weaving/knitting processing was measured, and a value obtained by multiplying the value by 100,000 was calculated. This operation was repeated 10 times, and the average value thereof was rounded off to one decimal place and defined as fineness (dtex).

C. Average Standard Deviation of Surface Roughness (Sq)

The woven/knitted fabric was fixed on a flat plate so that no load was applied, and the standard deviation of the surface roughness was measured 10 times by changing the position under the following conditions using a One-Shot 3D Shape Measuring Instrument VR-3200 manufactured by KEYENCE CORPORATION, and the average value thereof was taken as the average standard deviation Sq.

Magnification: 12 times

Measurement area: total area (machine direction 18 cm×transverse direction 24 cm)

Correction: surface shape correction, waviness removal, strength of correction=5

Filtering mode: Gaussian type

S-filter: none

F-operation: none

L-filter: none

D. Average Standard Deviation of Surface Roughness when Fabric is Elongated by 10% (Sqs)

The woven/knitted fabric was fixed on a flat plate in a state where the woven/knitted fabric is elongated by 10% in the yarn direction of the C-shaped cross-section fibers, and the standard deviation of the surface roughness was measured 10 times by changing the position under the following conditions using a One-Shot 3D Shape Measuring Instrument VR-3200 manufactured by KEYENCE CORPORATION, and the average value thereof was taken as the average standard deviation Sqs. The yarn direction of the C-shaped cross-section fibers refers to the warp (weft) direction when it is included only in the warp (weft) yarn in the woven fabric, and refers to the direction in which the elongation rate is high when it is included in both the warp yarn and the weft yarn. In the case of a warp knitted fabric, it refers to a machine direction (a direction in which loops are arranged vertically), and in the case of a weft knitted fabric, it refers to a transverse direction (a direction in which loops are arranged horizontally). In addition, the stress at the time of elongating the woven/knitted fabric is 4.0 N/cm or less, and the Sqs of the woven/knitted fabric which does not elongate by 10% under the stress of 4.0 N/cm cannot be measured.

Magnification: 12 times

Measurement area: total area (machine direction 18 cm×transverse direction 24 cm)

Correction: surface shape correction, waviness removal, strength of correction=5

Filtering mode: Gaussian type

S-filter: none

F-operation: none

L-filter: none

E. Water Retention Rate and Oozing Rate

The water retention rate and the oozing rate were calculated by the following method.

(1) A woven/knitted fabric (test piece) left under an environment of 20° C. and 65% RH for 24 hours was cut into a size of 10 cm×10 cm, and two filter papers and three films without water absorbency having the same size were prepared.

(2) The weight (W0) of the film and the weight (W1) of the test piece were measured.

(3) Using a syringe, 0.3 cc of distilled water was placed on the film, and the test piece was placed on a water droplet with the front surface facing upward and the back surface facing the water droplet side.

(4) After being left for 5 seconds, the weight (W2) of the test piece was immediately measured.

(5) The weight (W3) of the film after water absorption was measured.

(6) The weight (w1, w3) of two filter papers before water absorption was measured.

(7) The test piece was sandwiched from the front surface and the back surface of the filter paper whose weight was measured, and the test piece was sandwiched between the remaining two films which were not used in the above (3).

(8) A load was applied so that the pressure of the test piece was 5 g/cm$^2$, and immediately after being left for 1 minute, the weight (w2 (corresponding to w1 in (6) above), w4 (corresponding to w3 in (6) above)) of the filter paper on the front surface and the back surface was measured.

(9) The water retention rate (%) and the oozing rate (%) were calculated by the following equation, and the average value of 10 times was defined as the water retention rate (%) and the oozing rate (%).

$$\text{Water absorption rate (\%)}=100\times(W2-W1)/((W3-W0)+(W2-W1))$$

$$\text{Total oozing rate (\%)}=100\times((w2-w1)+(w4-w3))/((W3-W0)+(W2-W1))$$

$$\text{Water retention rate (\%)}=\text{water absorption rate (\%)}-\text{total oozing rate (\%)}$$

$$\text{Oozing rate (\%)}=100\times\tfrac{1}{2}\times((w2-w1)+(w4-w3))/(W2-W1).$$

F. Wearing Evaluation (Fabric/Skin Separation, Mobility, Sweat Transfer, Natural-Like Appearance)

Shirts having the same shape were made of the woven/knitted fabric, and the shirts were put on the bare skin and a gray jacket was put on the shirts as a jacket, and the natural-like appearance was evaluated by sensory evaluation according to the following criteria. Thereafter, the subject walked at a speed of 5 km/h for 20 minutes using treadmills in an environment of 27° C. and 75% RH. The fabric/skin separation of the shirt, mobility, and sweat transfer to the jacket at rest and when moving were determined according to the following criteria. This wearing evaluation was performed by 10 randomly selected people, and the fabric/skin separation, mobility, and sweat transfer were evaluated from the average value.

Natural-like appearance: Natural-like appearance=○, not natural-like appearance=x Fabric/skin separation at rest and when moving: excellent=⊙, slightly excellent=○, poor=x Mobility: excellent=⊙, slightly excellent=○, poor=x Sweat transfer: small=○, large=x G. Fiber Diameter The fiber diameter was determined by embedding a conjugate fiber in an embedding agent such as an epoxy resin and taking an image at a magnification at which 10 filaments or more of the fiber can be observed with a scanning electron microscope (SEM) in the transverse section of fiber in a direction perpendicular to the fiber axis. The diameters of fibers randomly extracted in the same image from each taken image were measured to the one decimal place in units of μm, a simple number average of the results obtained for 10 filaments was obtained, and the value obtained by rounding off the average to the nearest whole number was taken as the fiber diameter (μm). Here, when the transverse section of fiber in a direction perpendicular to the fiber axis was not a perfect circle, the area thereof was measured, and a value obtained by converting it into a perfect circle was employed.

H. Elongation Rate

The elongation rate when the woven/knitted fabric was elongated in the yarn direction of the substantially C-shaped cross-section fiber was determined according to JIS L 1096 (2010) 8.16.1 A method.

Example 1

Polyethylene terephthalate (SSIA-PEG copolymerized PET, melt viscosity: 100 Pas, melting point: 233° C.)

copolymerized with 8 mol % of 5-sodium sulfoisophthalic acid and 9 wt % of polyethylene glycol was prepared as Polymer 1, polyethylene terephthalate (IPA copolymerized PET, melt viscosity: 140 Pa·s, melting point: 232° C.) copolymerized with 7 mol % of isophthalic acid was prepared as Polymer 2, and polyethylene terephthalate (PET, melt viscosity: 130 Pa·s, melting point: 254° C.) was prepared as Polymer 3.

These polymers were separately melted at 290° C., Polymer 1/Polymer 2/Polymer 3 were weighed to a weight ratio of and the inflow polymers were ejected from the ejecting hole so as to form a flat conjugate fiber as shown in FIG. 1(*a*) having a composite structure in which Polymer 1 was ejected in the innermost layer and the communicating part (x in FIG. 1(*a*)) from the fiber center to the fiber surface, and Polymer 2 and Polymer 3 were bonded to the outermost layer (y, z in FIG. 1(*a*)) in a side-by-side manner.

The ejected composite polymer stream was cooled and solidified, then provided with an oil agent, wound at a spinning rate of 1500 m/min, and drawn between rollers heated to 90° C. and 130° C. to produce a conjugate fiber of 56 dtex/−36 filaments (fiber diameter: 12 μm).

The ratio RB/RA of the inscribed circle diameter RA to the circumscribed circle diameter RB of the obtained conjugate fiber was 1.8. It was also confirmed that the communication width was 0.5 μm, which was 4% of the fiber diameter of 12 μm.

Two of the obtained conjugate fibers were combined and twisted at 300T/M in the S direction, and the twisted yarns were used as warps and wefts to obtain a 2/2 twill woven fabric having a warp density of 135 yarns/2.54 cm and a weft density of 80 yarns/2.54 cm using a water-jet loom.

The obtained woven fabric was continuously scoured, subjected to wet heat relaxation at 130° C. for 30 minutes with a jet dyeing machine, subjected to an intermediate setting under the conditions of 180° C. for 1 minute and a tentering rate of 1%, and then heated to 100° C. with a jet dyeing machine using a 1% by weight aqueous sodium hydroxide solution to remove Polymer 1 (weight reduction rate: 22%). Thereafter, the woven fabric was subjected to water absorption processing using 5% owf of a polyester polyalkylene glycol copolymer resin (TM-SS21, manufactured by Matsumoto Yushi-Seiyaku Co., Ltd.) in combination with ordinary dyeing processing, and then to ordinary finishing processing to obtain a woven fabric having a warp density of 180 yarns/2.54 cm and a weft density of 105 yarns/2.54 cm. The evaluation results of the obtained woven fabric are shown in Table 1. In addition, 10% or more of the yarns of the multifilament were oriented in the same direction in the obtained woven fabric.

Example 2

Two conjugate fibers of 56 dtex/−36 filaments (fiber diameter: 12 μm) described in Example 1 were aligned in parallel, and a knitted fabric of a seed weaving having 42 wales/2.54 cm and 40 courses/2.54 cm was obtained by a single circular knitting machine. Thereafter, processing was performed by the processing method described in Example 1 to obtain a knitted fabric having a seed weaving of 42 wales/2.54 cm and 45 courses/2.54 cm. The obtained evaluation results of the knitted fabric are shown in Table 1. In addition, 10% or more of the yarns of the multifilament were oriented in the same direction in the obtained knitted fabric.

Example 3

A woven fabric having a warp density of 178 yarns/2.54 cm and a weft density of 103 yarns/2.54 cm was obtained in the same manner as in Example 1, except that the conjugate fiber of Example 1 was false-twisted at a magnification of 1.05 times, and two of these were used in combination as a processed yarn of 53 dtex-36 filaments (fiber diameter: 12 μm, communication width: 0.6 μm). The evaluation results of the obtained woven fabric are shown in Table 1. The obtained woven fabric had less than 10% of multifilaments oriented in the same direction.

Example 4

A woven fabric having a warp density of 175 yarns/2.54 cm and a weft density of 102 yarns/2.54 cm was obtained in the same manner as in Example 1, except that Taslan finished yarn (120 dtex-72 filament) in which the conjugate fiber of Example 1 was used as the core yarn and the sheath yarn was used alone. The evaluation results of the obtained woven fabric are shown in Table 1. In addition, 10% or more of the yarns of the multifilament were oriented in the same direction in the obtained woven fabric.

Example 5

A woven fabric having a warp density of 180 yarns/2.54 cm and a weft density of 105 yarns/2.54 cm was obtained in the same manner as in Example 1 except that conjugate fibers (fiber diameter: 12 μm, communication width: 0.5 μm) having a fiber cross section as shown in FIG. 1(*c*) were used. The evaluation results of the obtained woven fabric are shown in Table 1. The obtained woven fabric had less than 10% of multifilaments oriented in the same direction.

Comparative Example 1

A woven fabric having a warp density of 160 yarns/2.54 cm and a weft density of 95 yarns/2.54 cm was obtained in the same manner as in Example 1, except that the conjugate fiber (56 dtex-36 filament, fiber diameter: 12 μm) having a cross section shown in FIG. 2(*a*) using Polymer 2 and Polymer 3 of Example 1 was used and the woven weave was a plain weave. The evaluation results of the obtained woven fabric are shown in Table 1. The fabric/skin separation and water retainability were poor, and sweat transfer to the outer wear after exercise was remarkable. In addition, the appearance was not a natural-like appearance. In addition, 10% or more of the yarns of the multifilament were oriented in the same direction in the obtained woven fabric.

Comparative Example 2

A woven fabric having a warp density of 160 yarns/2.54 cm and a weft density of 95 yarns/2.54 cm was obtained in the same manner as in Comparative Example 1, except that the conjugate fiber (56 dtex-36 filament, fiber diameter: 12 μm) having a cross section shown in FIG. 2(*b*) using Polymer 2 and Polymer 3 of Example 1 was used. The evaluation results of the obtained woven fabric are shown in Table 1. The fabric/skin separation and water retainability were poor, and sweat transfer to the outer wear after exercise was remarkable. In addition, the appearance was not a natural-like appearance. The obtained woven fabric had less than 10% of multifilaments oriented in the same direction.

Comparative Example 3

A woven fabric having a warp density of 158 yarns/2.54 cm and a weft density of 95 yarns/2.54 cm was obtained in the same manner as in Example 5 except that Polymer 3 was used instead of Polymer 2. The evaluation results of the obtained woven fabric are shown in Table 1. The stretchability of the fabric was poor, and the fabric/skin separation and mobility were poor. In addition, the appearance was not a natural-like appearance. The obtained woven fabric had less than 10% of multifilaments oriented in the same direction.

Comparative Example 4

A woven fabric having a warp density of 163 yarns/2.54 cm and a weft density of 99 yarns/2.54 cm was obtained in the same manner as in Example 1, except that the conjugate fiber of Comparative Example 3 was false-twisted in the same manner as in Example 3, and two of these were used in combination as a processed yarn of 53 dtex-36 filaments (fiber diameter: 12 μm, communication width: 0.6 μm). The evaluation results of the obtained woven fabric are shown in Table 1. The unevenness of the fabric surface was reduced by the elongation of the fabric, and the fabric/skin separation was poor. In addition, the appearance was not a natural-like appearance. The obtained woven fabric had less than 10% of multifilaments oriented in the same direction.

Comparative Example 5

A woven fabric having a warp density of 180 yarns/2.54 cm and a weft density of 105 yarns/2.54 cm was obtained in the same manner as in Example 1, except that the conjugate fiber (56 dtex-36 filament, fiber diameter: 12 μm) having a cross section shown in FIG. 2(*c*) using Polymer 2 and Polymer 3 of Example 1 was used. The evaluation results of the obtained woven fabric are shown in Table 1. The water absorbency was low and the fabric/skin separation was poor, and the sweat transfer to the outer after exercise was remarkable. In addition, 10% or more of the yarns of the multifilament were oriented in the same direction in the obtained woven fabric.

Comparative Example 60

A woven fabric having a warp density of 160 yarns/2.54 cm and a weft density of 95 yarns/2.54 cm was obtained in the same manner as in Example 1 except that the same conjugate fiber as in Example 5 was used and the woven weave was plain weave. The evaluation results of the obtained woven fabric are shown in Table 1. Although non-uniform crepes were generated and the Sq value was large, unevenness feeling was reduced due to the elongation of the fabric and the fabric/skin separation was poor. The obtained woven fabric had less than 10% of multifilaments oriented in the same direction.

INDUSTRIAL APPLICABILITY

The woven/knitted fabric of the present invention is excellent in wearing comfortability and appearance by reducing the fabric sticking to the skin and the oozing of sweat to the outer during wearing. In addition, since the fabric has a natural-like appearance, it can be suitably used for general clothing such as jackets, skirts, pants, and underwear, sports clothing, clothing materials, and the like.

TABLE 1-1

| | | Example 1 | Example 2 | Example 3 | Example 4 | Example 5 |
|---|---|---|---|---|---|---|
| Fiber cross section in fabric | Cross-sectional shape | C-type | C-type | C-type | C-type | C-type |
| | Composite structure | Bimetal | Bimetal | Bimetal | Bimetal | Bimetal |
| | Modification degree (RB/RA) | 1.8 | 1.8 | 3.3 | 1.9 | 1.1 |
| Physical properties of fabric | Sq (μm) | 40 | 63 | 35 | 55 | 33 |
| | Sqs (μm) | 46 | 105 | 32 | 57 | 32 |
| | Sqs/Sq | 1.15 | 1.67 | 0.91 | 1.04 | 0.97 |
| | Elongation rate (%) | 25 | 30 | 28 | 23 | 22 |
| | Water retention rate (%) | 50 | 60 | 25 | 55 | 52 |
| | Sweat oozing rate (%) | 30 | 35 | 30 | 30 | 35 |
| Wearing evaluation | Fabric/skin separation at rest | ◎ | ◎ | ○ | ◎ | ○ |
| | Movability | ◎ | ◎ | ◎ | ○ | ◎ |
| | Fabric/skin separation when moving | ◎ | ◎ | ○ | ◎ | ○ |
| | Sweat transfer | ○ | ○ | ○ | ○ | ○ |
| | Natural-like appearance | ○ | ○ | ○ | ○ | ○ |

TABLE 1-2

| | | Comparative Example 1 | Comparative Example 2 | Comparative Example 3 | Comparative Example 4 | Comparative Example 5 | Comparative Example 6 |
|---|---|---|---|---|---|---|---|
| Fiber cross section in fabric | Cross-sectional shape | Flat hollow | Round hollow | C-type | C-type | Flat | C-type |
| | Composite structure | Bimetal | Bimetal | Alone | Alone | Bimetal | Bimetal |
| | Modification degree (RB/RA) | 1.8 | 1.1 | 1.1 | 2.0 | 1.8 | 1.1 |
| Physical properties of fabric | Sq (μm) | 5 | 4 | 4 | 28 | 38 | 67 |
| | Sqs (μm) | 4 | 3 | — | 22 | 43 | 15 |
| | Sqs/Sq | 0.80 | 0.75 | — | 0.79 | 1.13 | 0.22 |
| | Elongation rate (%) | 25 | 22 | 5 | 18 | 28 | 14 |
| | Water retention rate (%) | 15 | 10 | 25 | 23 | 15 | 48 |
| | Sweat oozing rate (%) | 50 | 45 | 35 | 30 | 50 | 37 |

TABLE 1-2-continued

| | | Comparative Example 1 | Comparative Example 2 | Comparative Example 3 | Comparative Example 4 | Comparative Example 5 | Comparative Example 6 |
|---|---|---|---|---|---|---|---|
| Wearing evaluation | Fabric/skin separation at rest | X | X | X | X | ○ | ◎ |
| | Movability | ○ | ○ | X | ○ | ◎ | ○ |
| | Fabric/skin separation when moving | X | X | X | X | X | X |
| | Sweat transfer | X | X | ○ | ○ | X | ○ |
| | Natural-like appearance | X | X | X | X | ○ | ○ |

DESCRIPTION OF REFERENCE SIGNS x: Easily soluble polymer y: Hardly soluble polymer on low melting point side z: Hardly soluble polymer on high melting point side a1, 2: Intersection of fiber surface and inscribed circle b1, 2: Intersection of fiber surface and circumscribed circle A: A circle that is inscribed at at least two points with the fiber surface, exists only inside the fiber, and has the maximum diameter that can be taken in a range in which the circumference of the inscribed circle and the fiber surface do not intersect.

B: A circle that is circumscribed at at least two points with the fiber surface, exists only outside the fiber, and has the minimum diameter that can be taken in a range in which the circumference of the circumscribed circle and the fiber surface do not intersect.

G: Fiber center

I: A straight line in which the area ratio of the hardly soluble polymer on high melting point side and the hardly soluble polymer on low melting point side in the right and left fiber cross sections with the straight line as a boundary is in the range of 100:0 to 70:30 in either one of the left and right fiber cross section and is in the range of 30:70 to 0:100 in the other fiber cross section, among straight line that divides the fiber cross section into two parts by area through the fiber center.

S: Straight line passing through fiber center G and parallel to communication part W: Width of communication part in direction perpendicular to straight line S

The invention claimed is:

1. A woven or knitted fabric comprising C-shaped cross-section fibers, wherein an average standard deviation Sq of surface roughness of at least one surface of the woven or knitted fabric is 5 μm or more and 100 μm or less, and a ratio (Sqs/Sq) of an average standard deviation Sqs of surface roughness of the one surface when the woven or knitted fabric is elongated by 10% to the average standard deviation Sq, is 0.85 or more and 2.00 or less.

2. The woven or knitted fabric according to claim 1, wherein the C-shaped cross-section fibers have a ratio (RB/RA) of an inscribed circle diameter RA to a circumscribed circle diameter RB in the cross-section of 1.2 or more and 5.0 or less.

3. The woven or knitted fabric according to claim 2, wherein the C-shaped cross-section fibers are C-shaped cross-section fibers in which at least two different polymers are unevenly distributed in the left and right in the C-shaped cross-section fibers.

4. The woven or knitted fabric according to claim 1, wherein the C-shaped cross-section fibers are C-shaped cross-section fibers in which at least two different polymers are unevenly distributed in the left and right in the C-shaped cross-section fibers.

5. The woven or knitted fabric according to claim 4, wherein the woven or knitted fabric includes at least one selected from a twill weave, a multiple weave, a fraise stitch, and a seed stitch.

6. The woven or knitted fabric according to claim 4, comprising a water-absorbent polyester resin.

7. The woven or knitted fabric according to claim 1, wherein the woven or knitted fabric includes at least one selected from a twill weave, a multiple weave, a fraise stitch, and a seed stitch.

8. The woven or knitted fabric according to claim 1, comprising a water-absorbent polyester resin.

9. The woven or knitted fabric according to claim 1, wherein a water retention rate is 20% or more.

10. The woven or knitted fabric according to claim 1, wherein a oozing rate is 40% or less.

* * * * *